United States Patent [19]

Holz et al.

[11] Patent Number: 4,532,505

[45] Date of Patent: Jul. 30, 1985

[54] GAS-FILLED DOT MATRIX DISPLAY PANEL

[75] Inventors: George E. Holz, North Plainfield; James A. Ogle, Neshanic Station, both of N.J.

[73] Assignee: Burroughs Corporation, Detroit, Mich.

[21] Appl. No.: 451,843

[22] Filed: Dec. 21, 1982

[51] Int. Cl.[3] ..... G09G 3/28

[52] U.S. Cl. ..... 340/775; 340/771; 315/169.4

[58] Field of Search ..... 340/769, 771, 773, 775, 340/776, 768; 315/169.4

[56] References Cited

U.S. PATENT DOCUMENTS

| | | | |
|---|---|---|---|
| Re. 31,231 | 5/1983 | Ogle et al. | 340/775 |
| 3,683,364 | 8/1972 | Holz et al. | 340/775 |
| 3,868,543 | 2/1975 | Holz et al. | 340/775 |
| 4,114,069 | 9/1978 | Yamaguchi et al. | 340/771 |
| 4,342,993 | 8/1982 | Holz | 315/169.4 |
| 4,414,490 | 11/1983 | Harvey | 315/169.4 |

*Primary Examiner*—Gerald L. Brigance

*Attorney, Agent, or Firm*—Kevin R. Peterson; Edmund M. Chung; Robert A. Green

[57] ABSTRACT

A display panel comprising a matrix of D.C. scan cells arrayed in rows and columns and a matrix of display cells arrayed in rows and columns, each scan cell being in operative relation with more than one display cell. The panel also includes a plurality of sustainer electrodes associated with rows of display cells and properly operated in conjuction with the scan cells to select and turn on desired display cells, column-by-column.

16 Claims, 12 Drawing Figures

GAS-FILLED DOT MATRIX DISPLAY PANEL

BACKGROUND OF THE INVENTION

A gas filled dot matrix display panel having memory is disclosed in copending application Ser. No. 051,313, filed June 22, 1979, of George E. Holz and James A. Ogle. This panel includes a matrix of D.C. scanning/address cells arrayed in rows and columns and a matrix of quasi A.C. display cells which are in operative relation with the scanning/address cells. In the panel, there is one scan cell for each display cell. The panel includes a relatively complex array of electrodes, and the scanning operation and addressing of display cells are relatively complex procedures.

In U.S. Pat. No. 3,683,364 of George E. Holz and James A. Ogle, a gas-filled SELF-SCAN display panel is described which includes an array of D.C. scanning cells and an array of D.C. display cells; however, the arrangement is such that each scan cell operates with more than one display cell. This principle of construction and operation has advantages which are utilized in the present invention.

DESCRIPTION OF THE INVENTION

Figure 1:
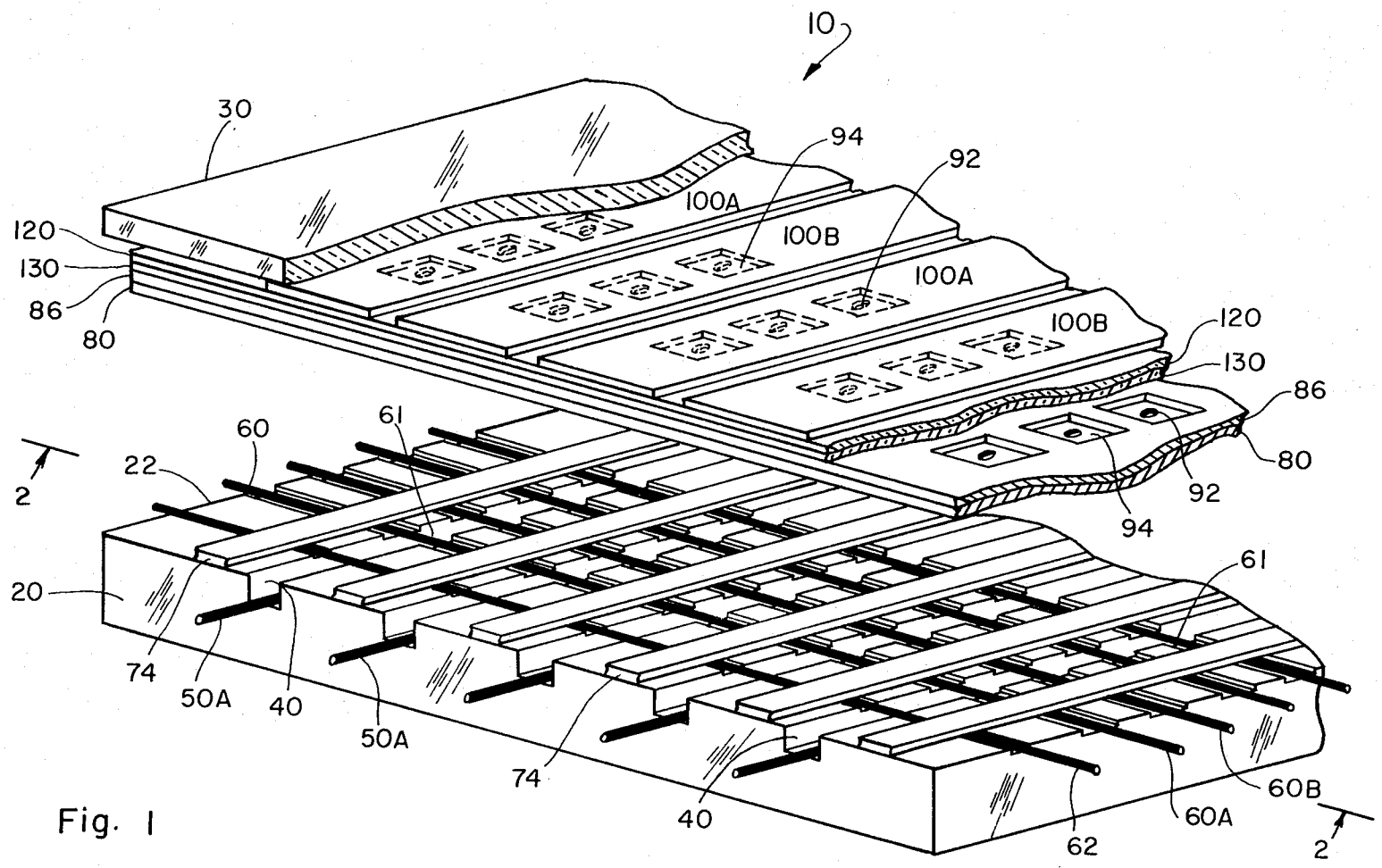
FIG. 1 is a perspective, exploded view, partly in section, of a display panel embodying the invention.

The present invention is embodied in a display panel 10 of the type described and claimed in copending application of George E. Holz and James A. Ogle, Ser. No. 051,313, filed June 22, 1979, which is incorporated herein by reference, along with the patents and publications cited therein. This application describes a dot matrix memory display panel including a D.C. scan/address portion and an A.C. display portion.

The display panel 10 includes a gas-filled envelope made up of an insulating base plate or substrate 20 and a glass face plate 30, which are hermetically sealed together along a closed periphery which surrounds the operating inner portion of the panel and the various gas cells provided therein. The base plate has a top surface 22, in which a plurality of relatively deep parallel longitudinal slots 40 are formed and in each of which a scan-/address anode electrode 50 is seated and secured.

Figure 2:
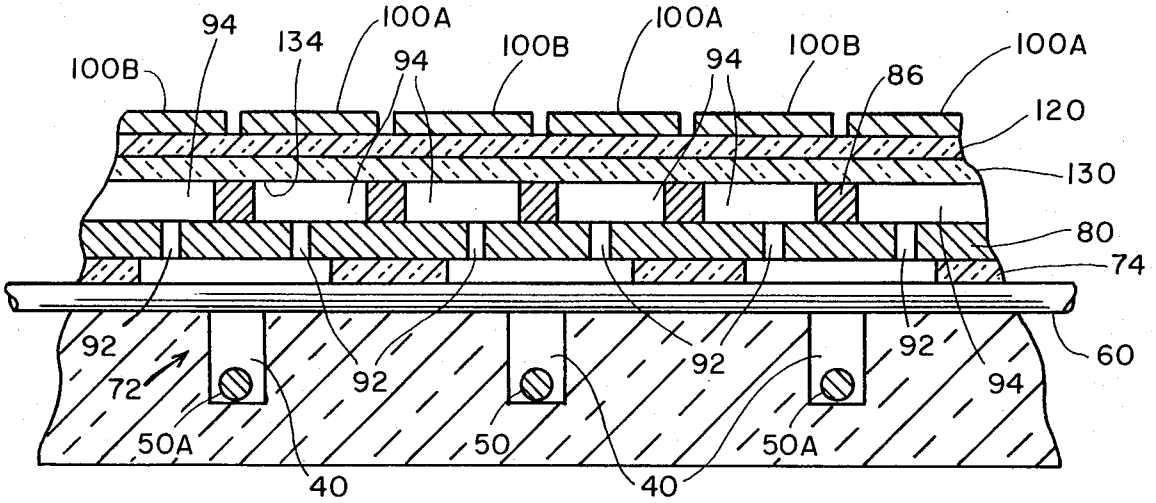
FIG. 2 is a sectional view of a portion of the panel of FIG. 1 taken along the lines 2—2 in FIG. 1.

A plurality of cathode electrodes 60 are seated in shallow, parallel slots 70 in the top surface 22 of the base plate. The cathodes 60 are called scan cathodes, and they are disposed transverse to the slots 40 and to scan anodes 50, and each crossing of a scan cathode 60 and a scan anode 50 defines a D.C. scan/address cell 72 (FIG. 2). It can be seen that the anodes 50 and cathodes 60 form a matrix of scanning cells which are arrayed in rows and columns.

The scan cathodes 60A, B, C, etc., form a series of cathodes which are energized sequentially in a scanning cycle, with cathode 60A being the first cathode energized in the scanning cycle.

A reset cathode electrode 62 is disposed adjacent to the first scan cathode 60A, and, where the reset cathode crosses the scan anodes, a column of reset cells is formed. These reset cells are turned on or energized at the beginning of each scanning cycle, and they generate excited particles which expedite the turn-on of the first column of scan/address cells associated with cathode 60A.

A strip 74 of insulating material is provided on the top surface of the base plate 20 extending along each land between each pair of anode slots 40.

Adjacent to the base plate or scan/address assembly described above is a quasi A.C. display assembly which includes a metal plate electrode 80, known as the priming plate, which has a matrix of rows and columns of relatively small apertures or holes 92, known as priming holes, with each column of priming holes aligned with and overlying one of the cathodes 60. In addition, along each row of holes, the holes are more or less grouped with each group overlying and in operative relation with the portion 61 of the underlying cathode associated with a scan cell. In FIG. 1, the priming holes are grouped in pairs, but other groupings may also be used. The plate 80 is positioned close to cathodes 60 and may be seated on insulating strips 74.

Seated on plate 80 is another apertured plate 86, the glow isolator plate, having rows and columns of apertures 94 which are larger than apertures 92. The apertures 94 comprise the display cells of panel 10, and each is disposed above one of the holes 92. The plate 86 may be of insulating material, or it may be of metal. Plates 80 and 86 may be made as one piece, if desired.

The quasi A.C. assembly also includes, on the inner surface of the face plate 30, a plurality of parallel strips 100A and 100B of transparent conductive material. These strips comprise A.C. electrodes known as glow sustaining electrodes. The strips 100 run parallel to the anodes 50, and each is so wide that it overlies one row of display cells 84 and one anode 50.

An insulating transparent coating 120 of glass covers electrodes 100, to make them A.C. electrodes, and, if desired, a dielectric layer 130 of magnesium oxide, thorium oxide, or the like is provided on glass layer 120.

The panel 10 includes a suitable keep-alive mechanism, one form of which is shown in U.S. Pat. No. 4,329,616 of Holz and Ogle. A keep-alive is not shown, to simplify the drawing, but is illustrated schematically in FIG. 1.

The gas filling in panel 10 is preferably a Penning gas mixture of, for example, neon and a small percentage of xenon, at a pressure of about 400 Torr.

Means for connecting the various electrodes of panel 10 to external circuitry are not shown, in order to simplify the drawings.

The panel 10 operates generally in accordance with the principles set forth in detail in copending application Ser. No. 051,313. A brief description of the operation of panel 10 is as follows, with the panel and an operating system being shown schematically in FIG. 3. The operating system includes a power source 170 for the keep-alive mechanism 171 and a source 172 of negative reset pulses coupled to reset cathode 62. The cathodes 60 are connected in groups or phases with, for example, every third cathode being connected together in the same group, to form three groups or phases, each group being connected to its own cathode driver 180. Other cathode groupings may also be employed, as is well known.

Each of the scan anodes 50 is connected through a suitable resistive path (not shown) to a D.C. power source 185 and to a source 186 of addressing or write signals to perform write and erase operations. The source of addressing signals 186 may include, or be coupled to, a computer and whatever decoding circuits and the like are required. A source 187 of D.C. bias potential is coupled to plate 80, and a source 188 of glow-sustaining pulses is connected to the transparent conductive strip electrodes 100A, and a similar source 189 of glow-sustaining pulses is connected to the strip electrodes 100B.

All of the circuit elements required to drive panel 10 are not shown, in order to keep the drawing as clear and simple as possible. Circuit elements such as diodes, resistors, ground connections, and the like can be readily provided by those skilled in the art and by reference to the application cited above and to the patents and articles referred to therein.

Figure 3:
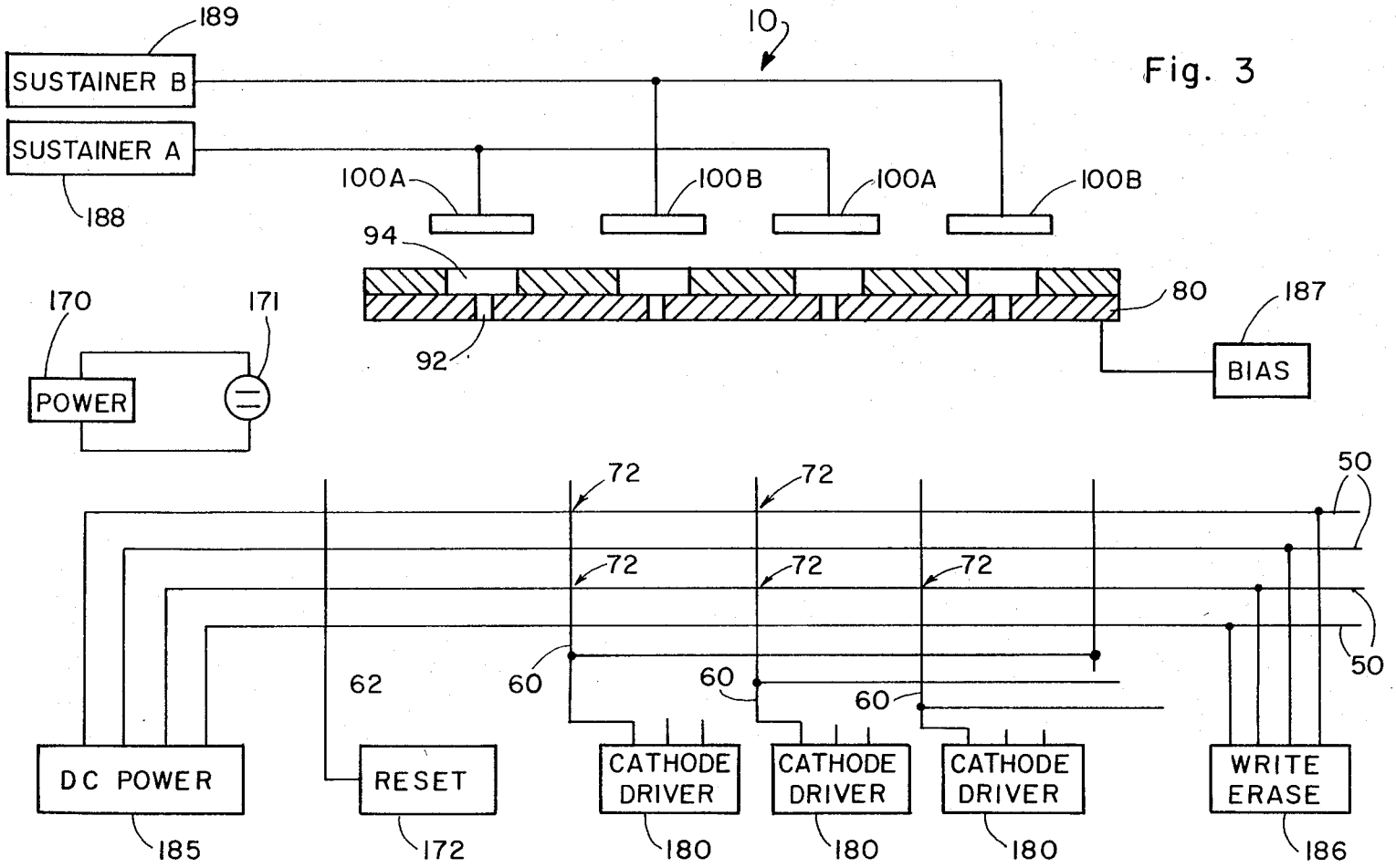
FIG. 3 is a schematic representation of the display panel of FIG. 1 in side elevation and an electronic system in which it may be operated.
Figure 5:
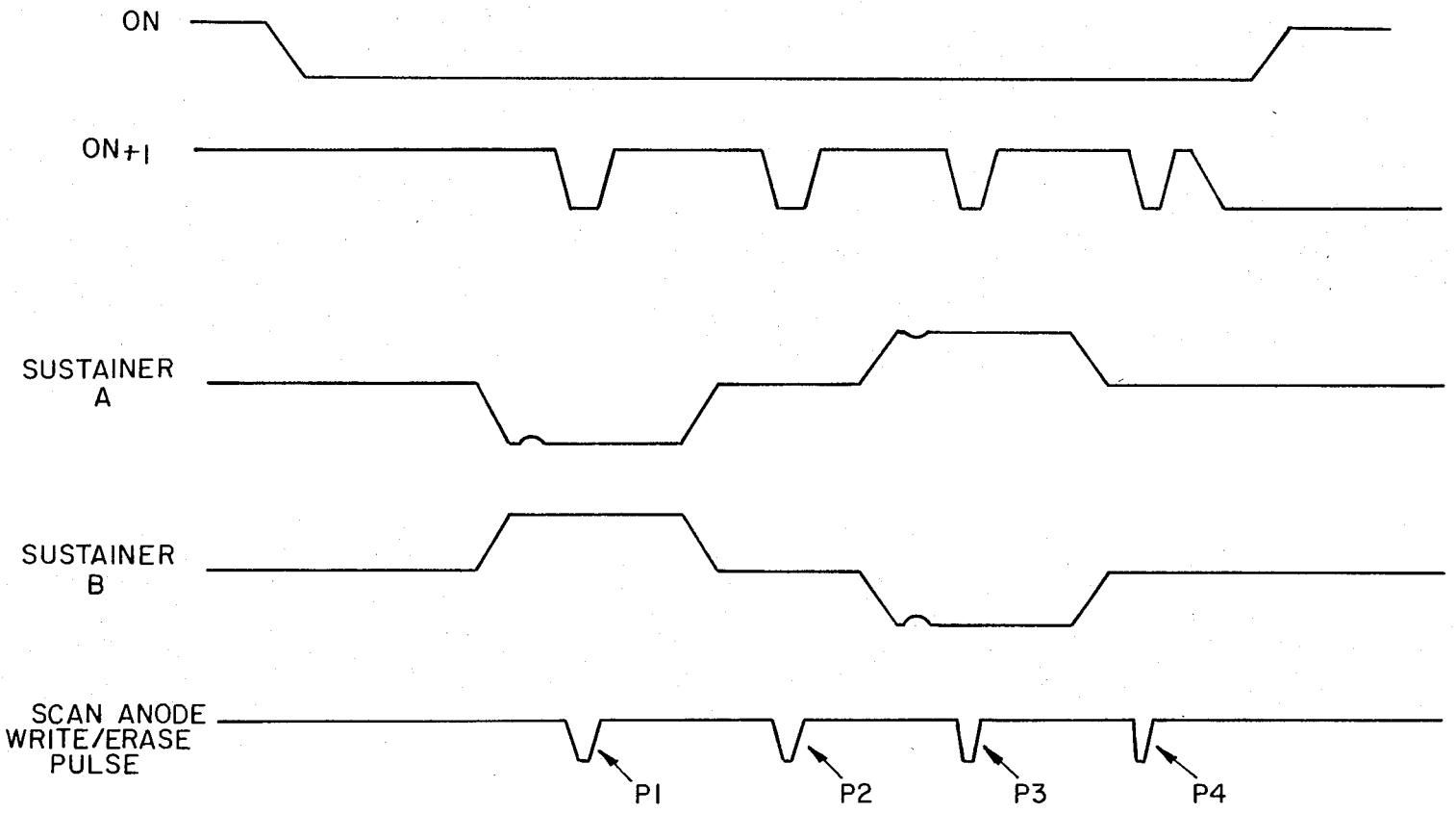
FIG. 5 shows some electronic waveforms used in operating the panel of the invention.

Briefly, in operation of the panel and system illustrated in FIG. 3, the scanning cells 72 are energized column-by-column at a selected scan frequency, and simultaneously sustainer pulses are applied from sources 188 and 189 to electrodes 100A and 100B, in synchronism with the column scan, so that, as each column of scan cells is being scanned, negative and positive sustainer pulses are applied to electrodes 100A and similar pulses are applied to electrodes 100B. The two sets of sustainer pulses are suitably out of phase with each other in accordance with the principles of the invention and generally as illustrated in FIG. 5.

Under these conditions, if the data or address signals from source 186 direct that a particular display cell be turned on, when the column containing the scan cell beneath that display cell is being scanned, that scan cell is momentarily turned off, in synchronism with, and during, the application of a positive sustainer pulse to electrodes 100A or 100B and it is then turned back on, so that the scanning operation can proceed normally. During the period when this scan cell is turned off, and its discharge is in the process of decaying, a positive column is drawn to electrode 80 and electron current flows from its electrode portion 61 to electrode 80, and electrons are drawn through the aperture 92 in electrode 80 into the selected display cell 94 by the positive sustainer pulse. This combination of effects, with some current multiplication probably occurring in the display cell, produces a negative wall charge on wall 134 of the selected display cell, and the combination of the voltage produced by this wall charge and the voltage of the next negative sustainer pulse produces a glow discharge in the selected display cell. This discharge, in turn, produces a positive wall charge on wall 134, which combines with the next positive sustainer pulse to produce a glow discharge, and, in similar manner, successive sustainer pulses produce successive discharges and consequent visible glow in the selected cell.

After all cell columns have been scanned and the desired display cells have been turned on, the sustainer pulses keep these cells lit and the written message displayed. If desired, at this time, the same sustainer signal can be applied to all of the sustainer electrodes 100A and 100B.

The erasing operation is similar. In erasing, as in writing, the selected display cell is operated upon while its underlying scan cell is being scanned, but the erase signal is applied in synchronism with, but following the negative sustainer pulse. For the erase operation, the associated scan cell is again turned off momentarily, and then back on, to avoid interfering with the normal column-by-column scan of the scan cells. While it is off, the decaying discharge around electrode portion 61 again produces electron flow to electrode 80, and through the aperture in that electrode into the display cell. This serves to remove, or neutralize, the positive charge then on wall 134 of the display cell (which charge was produced by the most recent negative sustainer pulse) so that the next sustainer pulse will fail to produce a glow discharge, and glow in the selected cell will cease.

Figure 4:
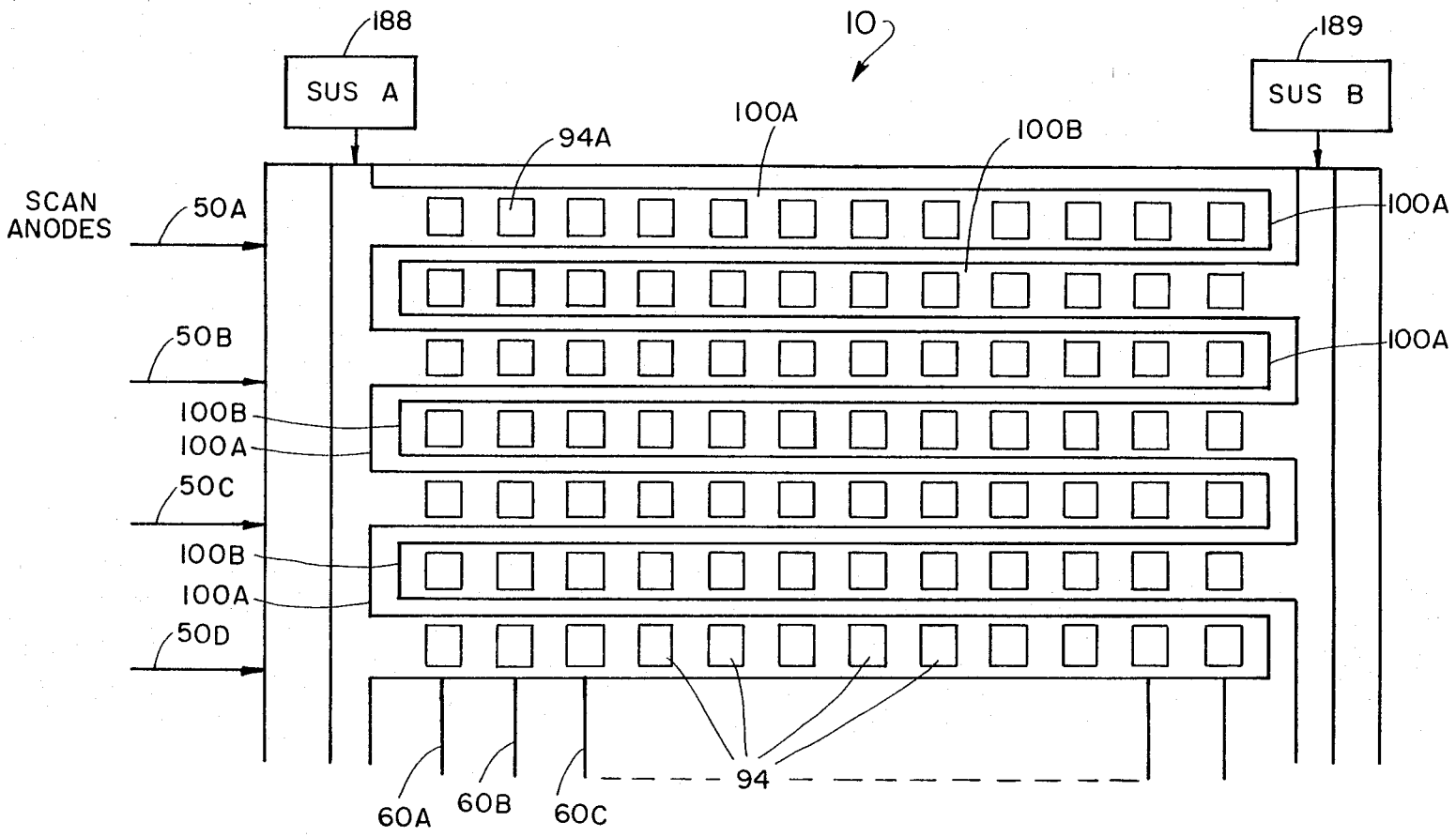
FIG. 4 is a schematic plan view of a portion of the display panel of FIG. 1 and electronic circuit elements with which it may be used.

The operation of the invention is described in somewhat greater detail with respect to FIGS. 4 and 5. FIG. 4 is a plan view of portions of the display panel 10 shown in FIG. 1, and FIG. 5 shows some of the waveforms applied to panel 10.

FIG. 5 shows the two sustainer pulses SUS A and SUS B from sources 188 and 189 as they appear in one column time and four possible write or erase conditions which may be achieved with address or data pulses P1, P2, P3, and P4 from source 186. These four possibilities are set forth in the following table.

TABLE

| Pulse: | P1 | P2 | P3 | P4 |
|---|---|---|---|---|
| SUS A: | — | erase | write | — |
| SUS B: | write | — | — | erase |

Thus, since pulse P1 is applied at the time that sustainer B is positive, then the display cell associated with sustainer B is turned on. Pulse P2 is applied after sustainer A has executed the negative portion of its cycle so that the display cell associated with sustainer A is erased. Pulse P3, like P1, is applied when sustainer A is at the positive portion of its cycle and its associated display cell is turned on; and pulse P4, like Pulse P2, occurs after the negative portion of the cycle of sustainer B so that the display cell associated with sustainer B is erased.

As a more specific example, referring to FIGS. 4 and 5, if it is desired to write or turn on display cell 94A, which appears at the crossing of scan anode 50A and cathode 60B, when the first column of scan cells is turned on and when electrode 100A has the positive portion of the sustainer pulse on it, the negative write pulse P is applied to scan/address anode 50A. This causes the positive column to be drawn from cathode 60B into display cell 94A, and the action described occurs and causes glow in display cell 94A. This glow is sustained by sustainer signal SUS A. The same operation is performed through the panel to turn on selected cells in each of the columns of display cells, and then the entire entered message is sustained by the same sustainer signal applied to all of the sustainer electrodes 100.

The waveforms of FIG. 5 illustrate that the two sustainer signals SUS A and SUS B applied to electrodes 100A and 100B are out of phase with each other. In one arrangement as illustrated, these two waveforms are exactly opposite in phase; however, other relationships may be employed within the spirit of the invention.

Figure 7:
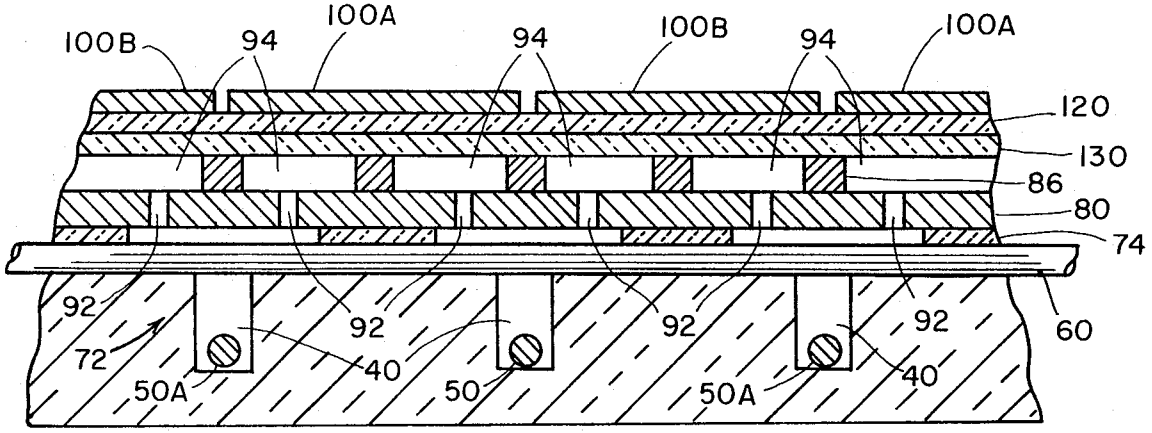
FIG. 7 is a sectional view alone the lines 5—5 in FIG. 4.
Figure 6:
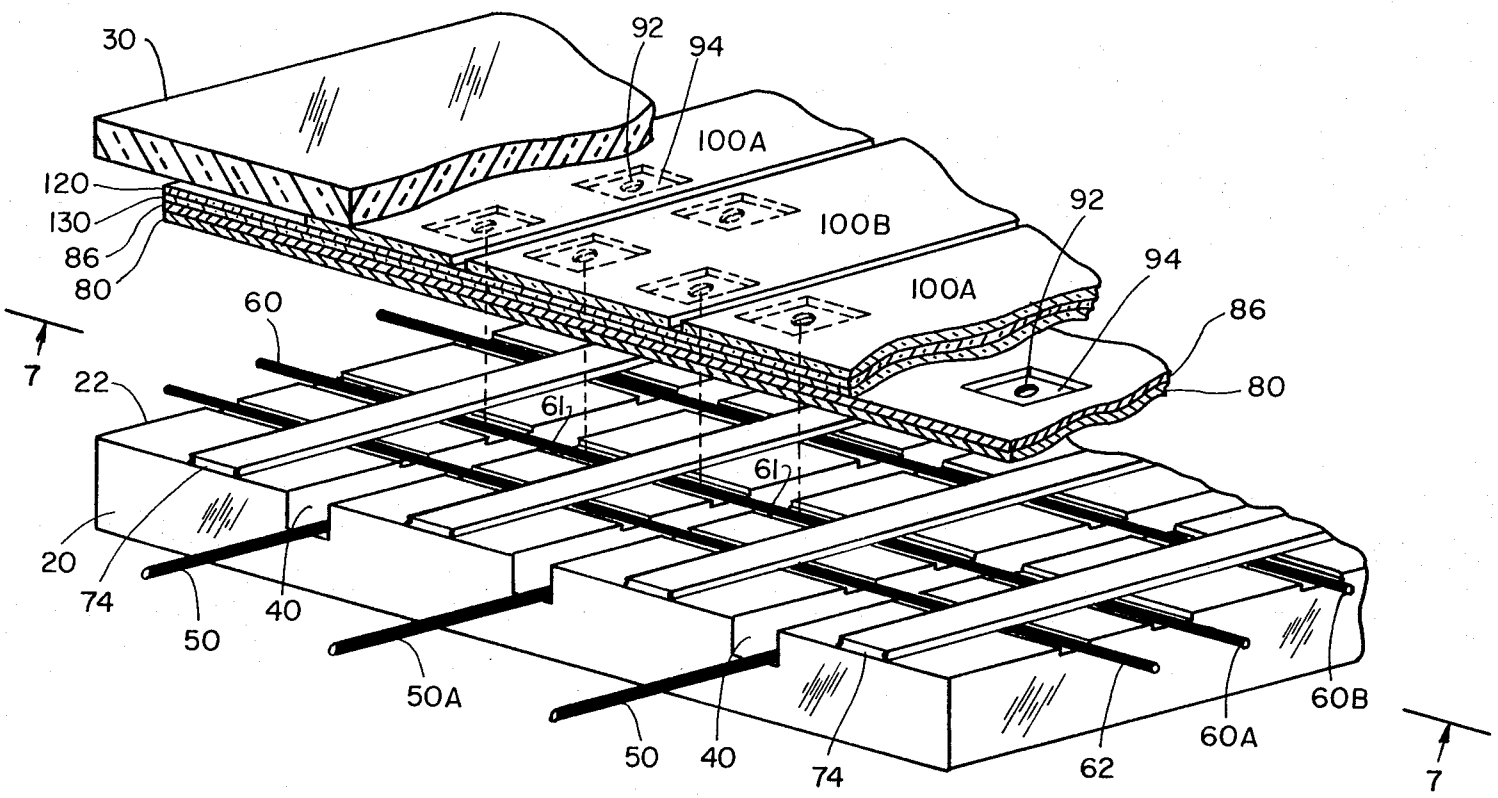
FIG. 6 is a perspective, exploded view, partly in section, of a modification of the invention.
Figure 8:
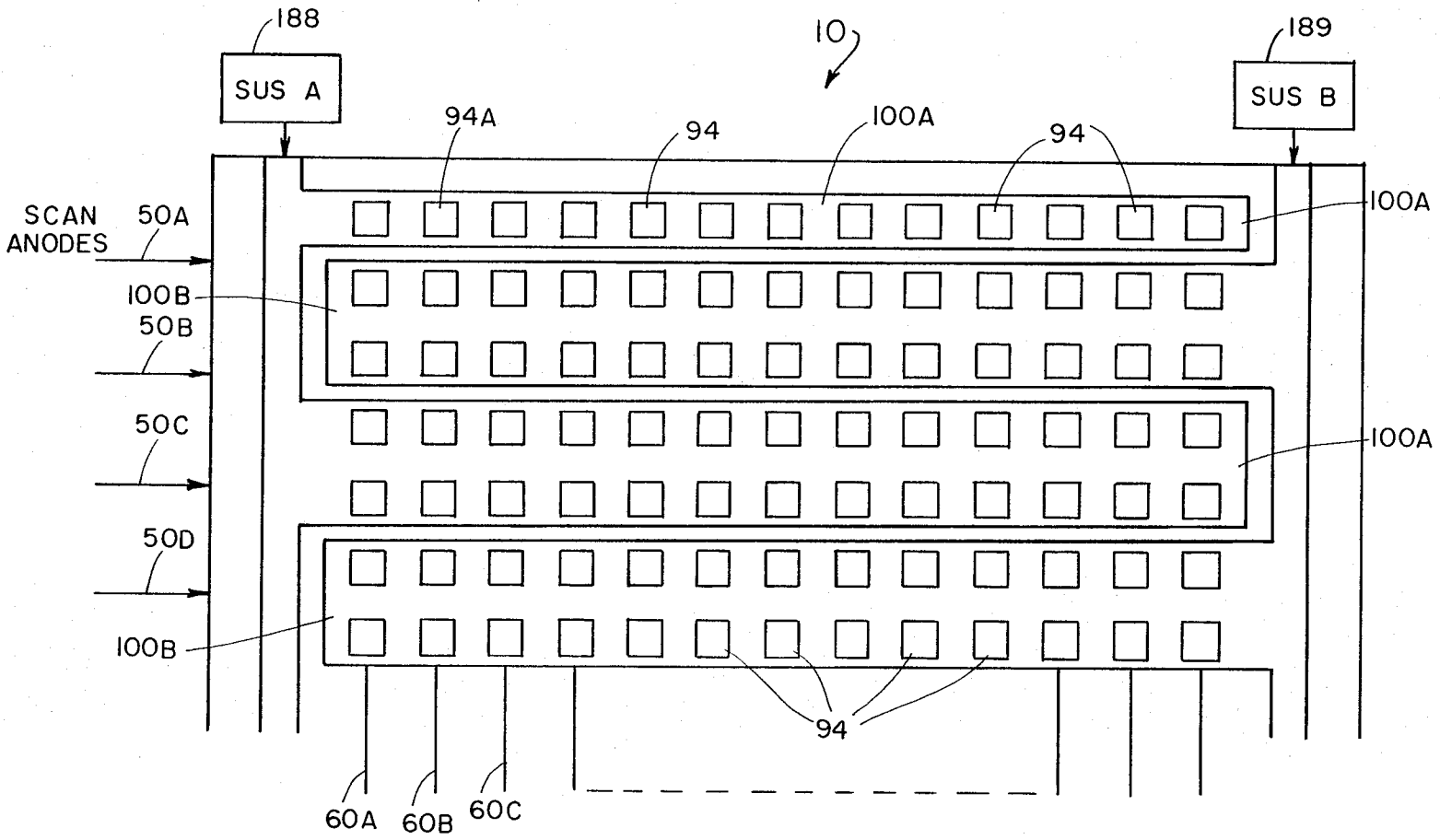
FIG. 8 is a schematic plan view of a portion of the panel of FIG. 6 and associated circuit elements.

In a modification of the invention illustrated in FIGS. 6, 7, and 8, the panel 10' includes all of the features of panel 10 except that the transparent conductive strip electrodes 100 are shaped (made wider) so that each overlies two adjacent longitudinal rows of display cells 94. If the panel includes an odd number of rows of cells, one electrode 100 would overlie only one row of cells, as illustrated in FIG. 8.

The operation of this embodiment of the invention would be the same as described above, with suitable modification to the electronic system to provide the desired interrelationship of scanning signals and sustaining signals.

It is noted that, in operation of panels embodying the invention, the system logic may be modified as required to write and erase display cells according to different patterns. For example, at any instant, cells associated with both electrodes 100A and 100B may be erased, or written, or any other pattern of operation may be followed.

According to the invention, several other possible operating systems represented by the sustainer waveforms or signals shown in FIGS. 9A, 9B, 9C, and 9D are described below. In these waveforms, the letter "W" represents a write or turn-on operation, and a letter "E" represents an erase operation. The letter "F" represents re-firing of an "on" cell. It is noted that, as a general rule, a cell which has been turned on, is re-fired and emits a pulse of light each time the waveform includes successive positive and negative pulses or negative and positive pulses.

Figures 9A, 9B:
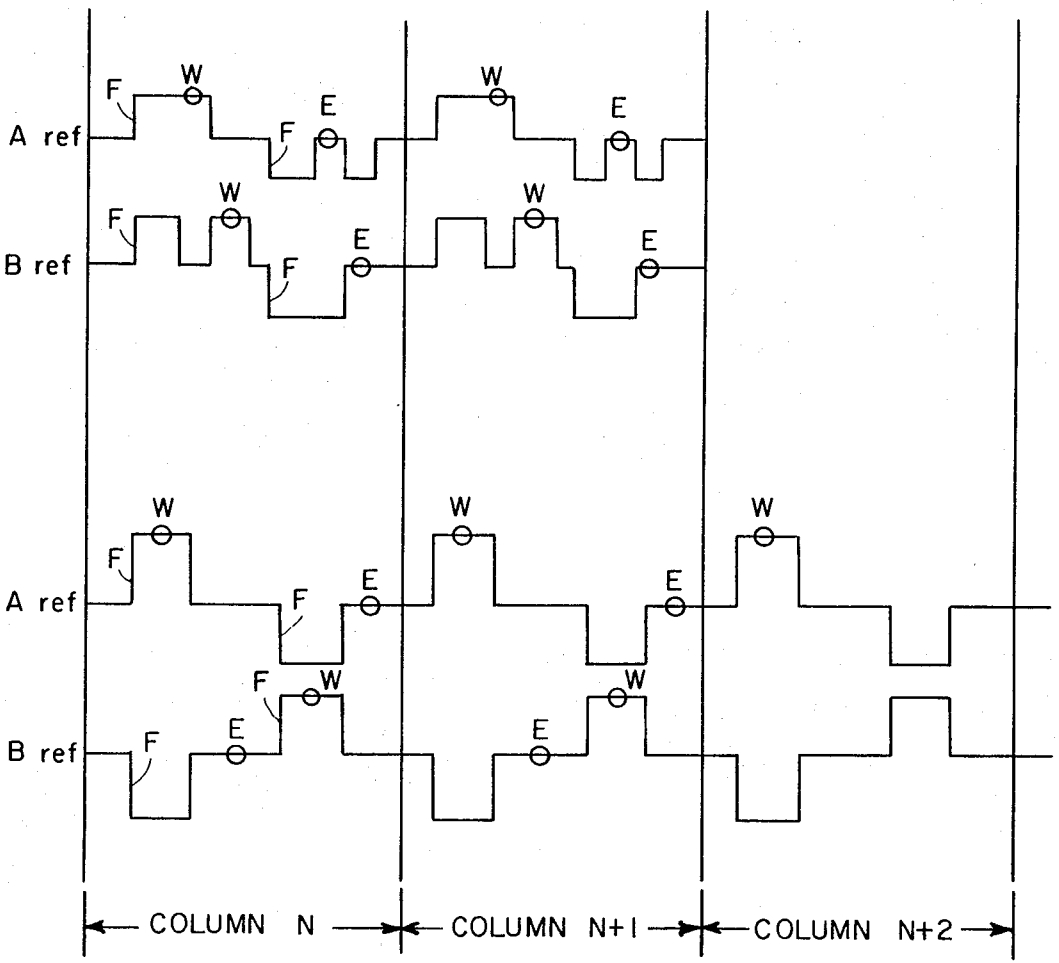
FIGS. 9A, 9B, 9C, and 9D show different sets of waveforms for operating the panels of the invention.

In the sustainer waveforms of FIG. 9A, one sustainer, e.g. sustainer A, includes in each column time, a positive pulse followed by two negative pulses, and sustainer B has two positive pulses followed by a negative pulse. The various write (W) and erase (E) operations shown can be performed.

The sustainer waveforms of FIG. 9B are essentially the same as those of FIG. 5 and are shown again for purposes of comparison with the other waveforms. The same conditions for write (W), erase (E), and for the sustainer firing or re-firing "F" of written or "on" cells is the same as above. These waveforms are perhaps the simplest in form in that each includes positive and negative pulses in series and one is 180° out of phase with the other. It is noted that there can be two re-firings "F" by each sustainer for each "on" cell in the display in each column time.

Figure 9C:
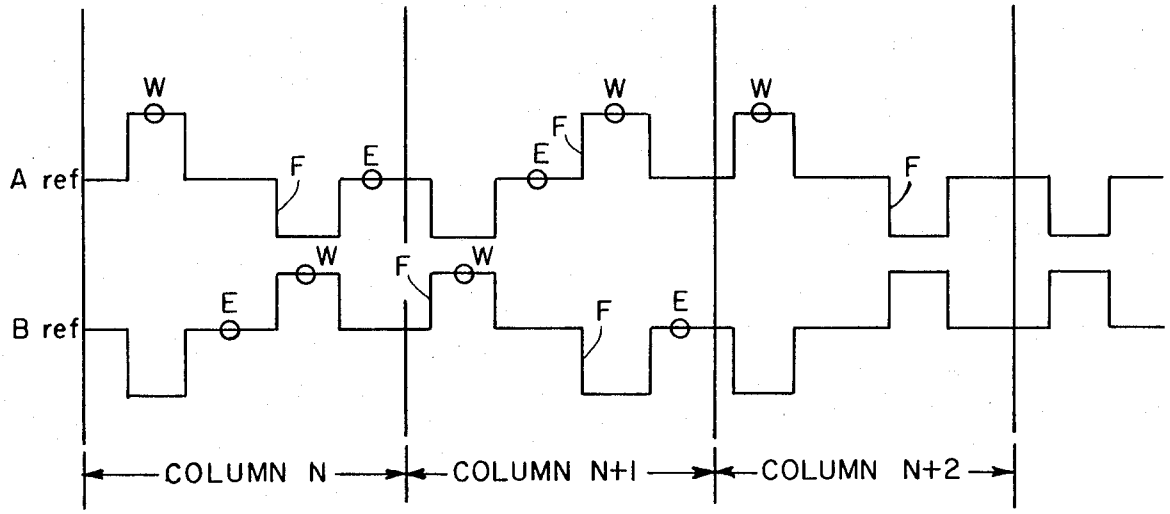

In the waveforms of FIG. 9C, sustainer waveforms A and B are complementary in form, like the waveforms of FIG. 9B; however, ignoring column times, each wave includes two positive pulses followed by two negative pulses. Write (W) and erase (E) functions can be performed as indicated following the same rules set forth above.

However, there is only one re-firing or glow discharge (F) per column time because of the make-up of the waveforms. When the sustainer waves of FIG. 9C are applied, an "on" cell will discharge or re-fire on the rise from reference of the leading edge of the first positive pulse referring to sustainer A, and then that cell will have negative wall charge inside it, and, when the second positive pulse comes along, nothing will happen. It merely will have the same effect as extending the first positive pulse. By the same token, the first negative pulse from reference that occurs will cause a discharge in an "on" cell. The second negative edge will have only the same effect as an extension of the negative pulse time; in other words, there will be no additional discharge. In each case, the cell biases itself off by accumulating a wall charge. Therefore, examination of these waveforms shows that there is only one discharge per column time. Since there is only one discharge per column time, if these column times were the same length as those of FIG. 9B, the display would appear half as bright. Therefore, when instead of the sustainer signals of FIG. 9B, one applies the sustainer signals of FIG. 9C, the column time can be cut in half in order to maintain the same frequency of light pulses and brightness from the "on" cells.

In practice, after the entire panel has had all of the desired cells addressed and written, then sustainer wave A alone is applied to all sustainer electrodes to maintain the "on" cells fired and the entered message displayed. It is noted that the higher speed of operation permits faster entry of data into the panel.

Figure 9D:
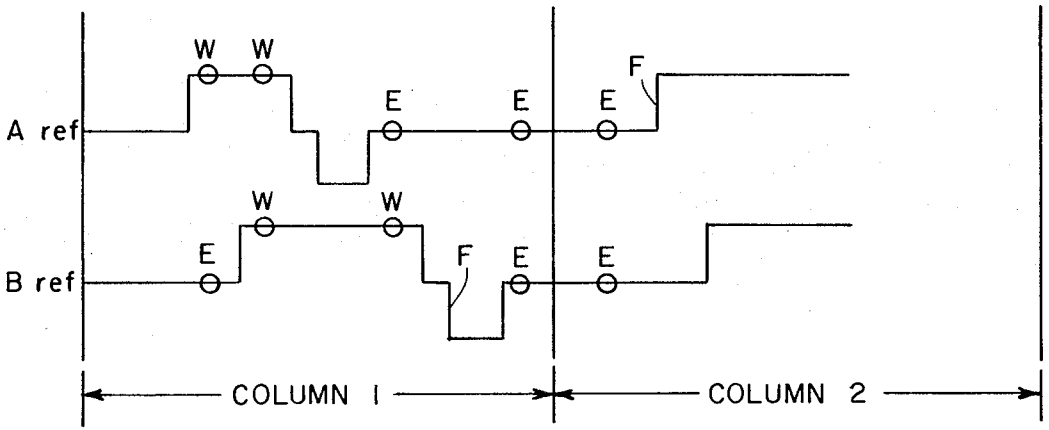

In FIG. 9D, the sustainer waves A and B and the permissible write (W) and erase (E) functions are as shown. With this set of waves, both A and B cells can be written at the same time or erased at the same time, or either one can be written while the other is erased, as shown.

What is claimed is:

1. A display panel comprising
   - a matrix of first gas-filled cells arrayed in rows and columns,
   - an anode electrode and a cathode electrode associated with said first cells,
   - each of said cathode electrodes including a series of operating cathode portions, each portion being associated with one of said first cells,
   - circuit means coupled to said anode and cathode electrodes for turning on said first cells in successive groups in a scanning cycle, the turn-on of said cells generating cathode glow,
   - a matrix of display cells arrayed in rows and columns,
   - each first cell and each operating portion of each cathode thereof being in operative relation with more than one display cell, and
   - a plurality of sustainer electrodes, there being one sustainer electrode for each of the display cells which is in operative relation with each cathode portion, so that, when a cathode portion is energized and exhibiting cathode glow, one of the display cells in operative relation therewith is selected and caused to glow by energization of its sustainer electrode.

2. The display panel defined in claim 1 wherein each anode electrode is aligned with a column of first cells and each cathode electrode is aligned with a row of first cells.

3. The display panel defined in claim 1 wherein said circuit means turns on said first cells column by column.

4. The display panel defined in claim 1 wherein each sustainer electrode overlies and is in operative relation with one row of display cells.

5. The display panel defined in claim 1 wherein each sustainer electrode overlies and is in operative relation with two adjacent rows of display cells, each row of the two rows operated by one sustainer electrode being associated with a different one of said anode electrodes whereby display cell selection may be achieved.

6. The display panel defined in claim 1 wherein said first cells are D.C. cells wherein said anode and cathode electrodes are in contact with the gas therein, and said sustainer electrodes are insulated from the gas.

7. The display panel defined in claim 1 and including an apertured electrode disposed between said first cells and said sustainer electrodes.

8. The display panel defined in claim 1 and including an apertured electrode disposed between said first cells and said sustainer electrodes, said apertured electrode including apertures made up of a lower small-diameter portion and an upper larger-diameter portion, said large-diameter portions comprising said display cells.

9. A display panel comprising a matrix of first gas-filled cells arrayed in rows and columns, an anode electrode and a cathode electrode associated with said first cells, said anode and cathode electrodes crossing each other, with each crossing defining one of said first cells, and with each cell including a portion of a cathode, there thus being rows of cathode portions corresponding to said rows of first cells, a matrix of display cells arrayed in rows and columns, each row of first cells and each row of operating portions of each cathode thereof being in operative relation with more than one row of display cells, a sustainer electrode overlying and in operative relation with each row of display cells, and first means for applying first sustainer signals to selected ones of said sustainer electrodes and second means for applying second sustainer signals to others of said sustainer electrodes, said first and second sustainer signals being applied simultaneously to adjacent sustainer electrodes associated with adjacent rows of display cells, but having such a phase relationship that display cells in one row or in the other row or in both rows can be addressed at any moment.

10. The panel defined in claim 9 wherein said first means for applying first sustainer signals is coupled to every other sustainer electrode and said second means for applying second sustainer signals is applied to all other sustainer electrodes not connected to said first means.

11. The panel defined in claim 9 wherein said first sustainer signals comprise a series of pulses made up of a positive pulse followed by two negative pulses and said second sustaining signal comprises a series of pulses made up of two positive pulses followed by a negative pulse, each positive pulse of said first signals coinciding generally with two positive pulses of said second signals and two negative pulses of said first signals coinciding generally with one negative pulse of said second signals.

12. The panel defined in claim 9 wherein said first and second sustaining signals comprise a series of pulses including two positive pulses and two negative pulses, said first and second signals being opposite in phase so that positive pulses in one signal coincide with negative pulses in the other signal and vice-versa.

13. A display panel and system comprising a matrix of first gas-filled cells arrayed in rows and columns, an anode electrode and a cathode electrode associated with said first cells, each of said cathode electrodes including a series of operating cathode portions, each portion being associated with one of said first cells, circuit means coupled to said anode and cathode electrodes for turning on said first cells column by column in a scanning cycle, the turn-on of said cells generating cathode glow, said circuit means also being operable to turn off each anode selectively to turn off the first cells associated therewith, a matrix of display cells arrayed in rows and columns, in each column of first cells and display cells there are two display cells associated with each first cell and each cathode portion, a sustainer electrode disposed along each row of display cells, and a source of sustainer signals coupled to each sustainer electrode with different sustainer signals applied simultaneously to adjacent sustainer electrodes and thus to adjacent rows of display cells, the sustainer signals which are applied to adjacent sustainer electrodes having such a phase relationship that display cells in one row or in the other row or in both rows can be addressed and turned on selectively.

14. The panel and system defined in claim 13 wherein each sustainer signal includes a series of two positive pulses and then two negative pulses, the two sustainer signals being 180° out of phase with each other so that positive pulses in one occur at the same time as negative pulses in the other, and vice versa.

15. The panel and system defined in claim 13 wherein, in one column time, one sustainer signal includes a positive pulse and two negative pulses in series and the other sustainer signal includes two positive pulses and one negative pulse in series.

16. The panel and system defined in claim 13 wherein, in one column time, one sustainer signal includes in series a positive pulse, a negative pulse and an elongated period at reference level, and the other sustainer signal includes an elongated positive pulse, which occurs at the same time as the positive and negative pulses of the first signal, and a negative pulse which occurs while the first pulse is at reference level.

* * * * *